United States Patent [19]

McCulloch

[11] Patent Number: 4,985,093

[45] Date of Patent: Jan. 15, 1991

[54] MELT CAST EXPLOSIVES

[75] Inventor: Charles R. McCulloch, Atlanta, Ga.

[73] Assignee: Explosive Research and Development Corporation, Atlanta, Ga.

[21] Appl. No.: 436,575

[22] Filed: Nov. 15, 1989

[51] Int. Cl.[5] ..... C06B 45/10

[52] U.S. Cl. ..... 149/19.4; 149/18; 149/105

[58] Field of Search ..... 149/18, 19.4, 105

*Primary Examiner*—Edward A. Miller

*Attorney, Agent, or Firm*—Lowe, Price, LeBlanc, Becker & Shur

[57] ABSTRACT

An explosive composition is described which is castable without voids and is stable between −65° F. and 165° F. The composition consists of 2,4,6 trinitrotoluene dissolved in a cross-linked low molecular weight polymer. The polymer is preferably a hydroxyl telomerized polyol cross-linked with a polyisocyanate. Both the polyol and the polyisocyanate should have the molecular weight of no more than about 1000.

5 Claims, No Drawings

MELT CAST EXPLOSIVES

FIELD OF THE INVENTION

This invention relates to an explosive consisting of a base of 2, 4, 6-trinitrotoluene (TNT) in a cross-linked polymer which may contain one or more particulate or crystalline explosives or explosion enhancing additives. The composition is a relatively homogeneous mixture which does not exhibit undue shrinkage upon solidification and which is not subject to deficiencies in storage, response to impact, and the like associated with TNT or other sensitive explosives of conventional formulation.

BACKGROUND OF THE INVENTION

While TNT-based explosives have been known for many years, in the military field of cast explosives for shaped charges and the like they suffer from several deficiencies. Such explosives have been subject to detonation in response to impact, flame, heat, and static electric loads. In addition, TNT melts at about 80° C. and when cast it is subject to a dramatic volume change in the cool down to ambient temperature. TNT will exhibit a density at 80° C. of 1.44 grams per cc. At ambient that density increases to 1.65 grams per cc. The volume decrease resulting is about 12%. Therefore, normal procedures use an overcasting process with "risers" which require then a machining of the cast explosive and usually discarding of the excess.

TNT is in wide use as an explosive and as an explosive base because it is cheap to produce, even in large quantities. TNT can be produced with low cost, low shear mixers that are easy to install and automate.

When TNT is mixed with other explosives, other deficiencies are exhibited. There often is the absence of a predictable response because the explosive mixture itself is nonhomogeneous. Explosive grains have been known to be subject to sedimentation. There also has been exhibited an absence of an explosive/lens bond which grossly affects the reliability of armor penetrating shaped charge munitions. In addition, the military standards require that the explosive be reliable over a temperature range of −65° to +165° F. without exhibiting brittleness or without exuding oil or the like and that this reliability be established over long term storage. Finally, many TNT explosives can exhibit detonation in massive storage which precludes the use of low cost nonreveted storage, low cost transportation, minimal tactical response times and minimum vulnerability of personnel in military platforms.

These deficiencies were alleviated in part with plastic bonded explosive systems (PBX's ). These systems are obtained by the incorporation of particulate explosives in an inert elastomeric substrate which attenuates the rate of energy transfer to provide below detonation levels while achieving a reproducibility adequate for most munitions. These results are achieved at the cost of performance and increased process costs. The cost in performance reflects the parasitic effect of the inert binder and the high process costs are caused by the necessity of using high shear and high cost mixers capable of handling the high viscosity characteristics of PBX systems.

In U.S. Pat. No. 3,447,980 it was disclosed that a polyurethane prepolymer in combination with a curing agent such as hydrogenated castor oil when combined with liquid TNT and one or more other explosives could produce a castable explosive which would not shrink on cooling. However, in subsequent patents such as U.S. Pat. No. 4,284,442, this disclosure was characterized as being difficult to use in that it had a very short pot life before gelation and exhibited irreversible chemical curing of the polyurethane elastomer. The solidified composition then could not be re-melted and re-formed as a mixture. Other attempts to provide a castable TNT-based explosive are described, for example, in U.S. Pat. No. 4,012,245 wherein the additive is an organic polyisocyanate, a hydroxyl-terminated butadiene polymer liquid resin and an abietyl alcohol. Also, in U.S. Pat. No. 4,325,759 TNT and a polymer are dissolved in methyl ethyl ketone and then re-precipitated as granules which are then incorporated in molten TNT.

There are several known high explosives which are more efficient for certain purposes than TNT. These include cyclotrimethylene trinitramine (RDX), cyclotetramethylene tetranitramine (HMX), nitroguanidine (NQ), 3 nitro 1,2,4 triazoyl 5-one (NTO) and ammonium picrate. For the most part these individual high explosives are too sensitive to be used alone. A common explosive is identified as Composition B (CompB) which typically consists of 60% RDX, 40% TNT, and added wax desensitizers. This composition, however, suffers from the above infirmities, and in addition, if the RDX crystals are dispersed in molten TNT, sedimentation may occur.

SUMMARY OF THE INVENTION

It has been discovered, however, that the TNT moiety in melt cast explosives can be dissolved in certain polymeric solvents having sufficient elastomeric characteristics to provide a desensitizing effect on the explosive with minimal compromise of explosive performance, and that such a solution lies within a viscosity regime compatible with low shear mixture TNT facilities and high volume production. Such munitions then can be produced at low cost through automation already present in existing TNT process plants. Such oligomeric precursors according to this invention have been found to act as processing agents for TNT-based explosives by allowing an increase in the more potent particulate explosives in the melt without compromising viscosity. Such combination explosives have been found to retain in solution large quantities of TNT over the desired temperature range of −65° to 165° F. Whereas normal plastic based explosives (PBX) formulations are limited to solids loading of 70–85 wt. % because of the limitation of processability, the explosive systems of this invention are characterized by concentrations of 90–98 wt. % content of such explosives.

Furthermore, the solvents of this invention obtain a void free homogeneous mixture of explosive grains in TNT which is not subject to shrinkage on cooling which is peculiar to conventional TNT-based explosives. The TNT moiety is in solution then at temperatures below the meltpoint of the TNT base. Volume change associated with the solid-liquid transformation then is depressed and this depression eliminates the necessity for the use of risers and the consequent production loss through post machining of the cast explosive.

It has been discovered, however, that by cross-linking a low molecular weight, low melting point hydroxyl telomerized polyol of a functionality of at least two, a highly efficient polymeric solvent binder for TNT can be provided. The solvent binder of this invention then provides a homogeneous mixture with TNT and other explosives which is sufficiently desensitized without sacrifice of explosive characteristics. Most importantly, however, the polymeric solvent binder of this invention in combination with TNT and alone or in combination with other explosives can be processed in conventional low shear mixtures and when cast will not unduly shrink upon solidification.

Accordingly, it is an object of this invention to provide a cross-linked polymeric solvent binder for TNT which can be processed to produce highly efficient cast explosives which solidify without undue shrinkage.

It is another object of this invention to provide a polymeric solvent binder for TNT which can be readily processed into cast explosive compositions using TNT alone or in combination with other explosives and which can be processed in a low shear mixer in a conventional TNT producing plant.

It is yet another object of this invention to provide a solvent binder for TNT which in combination with TNT can also retain up to 98% by weight of additional solid or crystalline explosives.

It is yet another object of this invention to provide a hydroxyl telomerized polyol of functionality of at least two, used as a processing agent to reduce viscosity which is subsequentally cross-linked with a polyisocyanate to provide a high molecular weight solvent binder for TNT which will not become brittle, exude oil and which may be stored safely over a temperature range of −65° to 165° F.

These and other objects will become readily apparent with reference to the following description.

DETAILED DESCRIPTION OF THE INVENTION

The polymeric solvent binder of this invention is, as noted above, a liquid or low melting hydroxyl telomerized polyol chain extend and cross linked by reaction with isocyanates of functionality of at least two. Polyols of this invention should contain groups such as ethers, ketone, nitrile, nitro groups (aliphatic/aromatic) amides, urea, urethane, and carbamates structures. Preferably, polyethers and or polyesters having a molecular weight range of 200–1000 are used. Most preferably, polyethylene glycol or polypropolene glycol of a molecular weight of 500–1,000 and/or polyethylene glycol adipate combined with isomeric structures designed to lower the melting point is reacted with an isocyanate such as the diisocyanate sold under the trademark PAPI 135 having a functionality of 2.3. This compound is now available through the owner of the trademark Dow Chemical Company of Midland, Mich., and was formerly available from the Upjohn Company of Kalamazoo, Mich.

It is important that the solvent polymer have a solubility parameter range (Sigma) of 10.5 to 13.5 $(cal./cc)^{\frac{1}{2}}$ and a density range of 1.05 to 1.37 g./cc. Most preferably, the solubility range is 11.5 to 12.5 $(cal./cc)^{\frac{1}{2}}$ at densities on the range of 1.15 to 1.37 g./cc which approximates the solubility parameter of TNT.

The polymer solvent chosen increases the solubility of TNT in the polymer. For example, in the elastomer system of this invention, 250–300 g. TNT can be dissolved in 100 g. binder at 25° C. and at any temperature above that. At −65° F. it would be expected that about 50 g. will be still be in solution.

This invention contemplates in a TNT system that TNT can be present in wt. % of from 15–90% and the binder of this invention present in from 85–10%. However, in a combination system TNT may be present in from 90–16%, and the binder can be present in from 10–2% whereas the particulate may be present in up to 82%.

The particulate explosives may be HMX, RDX, NQ and NTO as noted above. Oxidizers such as sodium, potassium, barium and lead salts of nitric and perchloric acids can also be present. Also metallic powders, as reducing agents, including magnesium as an incendiary agent, and aluminum and beryllium as blast enhancers can be present.

EXAMPLE 1

To 1,000 g. batch of CompB was added sufficient Class 1.5 RDX and a polyethylene oxide glycol (functionality of 2) and a polyfunctional isocyanate (polyarylene polyisocyanate of functionality of 2.7) to produce an explosive composition with the following formulation:

| Components | Wt. % |
|---|---|
| RDX | 65.0 |
| TNT | 25.0 |
| Binder | 10.0 |

The mixture was cured at 135° F., was purple in color, and had a detonation velocity of 7.67 at a density of 1.67 g./cc. Flow characteristics were superior to the initial flow characteristics of the initial Comp B system. Flow was maintained down to a temperature below the normal free point of the TNT adduct. Temperature cycling of the product over the temperature range of −65° F. to +165° F. in 30 cycles did not produce exudation or change in dimension.

EXAMPLE 2

A 2500 g. batch of the following composition was prepared:

| Component | Wt. % |
|---|---|
| HMX | 80.0 |
| TNT | 17.0 |
| Binder (as in Example 1) | 3.0 |

This composition was processed at 180° F. and cured at 135° F. to produce a chocolate colored explosive. The resultant product had a detonation velocity of 8.25 km./sec. at a density of 1.82 g./cc (estimated). The card gap value (NOL) was 187 cards. The card gap value for Octol (75/25 wt. % HMX/TNT) is 220–230 cards indicating that the system is less sensitive than Octol (75/25) while the detonation velocity is essentially comparable to Octol.

EXAMPLE 3

A 2500 g. batch of the following composition was prepared:

| Component | Wt. % |
|---|---|
| HMX | 82.0 |
| TNT | 15.0 |
| Binder (as in Example 1) | 3.0 |

The composition was cured at 135° F. to produce a tan colored explosive. The detonation velocity was 8.51 km./sec. at a density of 1.84 g./cc. The colorations observed may reflect the precipitation of nitramines dissolved in the TNT melt at submicron particle size. Shrinkage of the composition was estimated to be in the range of 0.2% by comparing the measurement of diameter of the cylinder cast charges. Crystallization patterns normally obtained with TNT compositions during cool down were not observed.

In each of examples 2 and 3 the binder was the same as in Example 1 for comparison purposes. The TNT/polymeric solvent precursors at 71.0/29.0, 83.0/17.0 and 85/15 wt. % levels were amber colored solutions with no propensity to orient the TNT crystalline habit on cool down.

In addition, NQ systems with TNT were also prepared and tested. The compositions were chocolate brown in color. The following are Class 1.6 systems.

EXAMPLE 4

A system of 70% NQ, 20% TNT and 10% binder exhibited a detonation velocity of 6.78 km./sec. at a density of 1.70 g./cc. The binder was the same as in Example 1. The system had a card gap value of 75 to 80 which meets the requirements for a Class 1.6 explosive.

EXAMPLE 5

In another system the concentration was 64% NQ, 27% TNT and 9% binder. The binder was the same as in Example 1. This system had a detonation velocity of 6.90 km./sec. and a card gap value of 70 to 75 at a density of 1.7 g./cc. This card gap value corresponds to an initiation pressure of 70 kilobars at a density of 1.70 g./cc.

EXAMPLE 6

In this system NQ was present in a concentration of 64%, 27% TNT and 9% binder. The binder was the hydroxyl terminated polypropylene glycol having a molecular weight of 1960, cross-linked with PAPI 135. This system was brown and exhibited a detonation velocity of 4.98 km./sec. The card gap value was 70–75 and the critical diameter was estimated at 3.5 inches.

Systems were also tested including HMX as follows:

EXAMPLE 7

In this system NQ was present in a concentration of 52%, HMX 12%, TNT 27% and binder 9%. The binder was the same as in Example 1. The product also was brown and exhibited a detonation velocity of 6.94 km./sec. The critical diameter, however, was 1.75 inches. The card gap value was 105–110.

EXAMPLE 8

In this system NQ was present in a concentration of 52%, HMX 12%, TNT 27% and binder 9%. The binder in this case, however, was the hydroxyl terminated polyester identified by the trade name PLASTOLIEN, a product available through the Emery Company of Cincinnati, Ohio. PLASTOLIEN was crosslinked with the diisocyanate PAPI 135. The system was cream colored and exhibited a detonation velocity of 6.94 km.sec. The critical diameter, however, was less than 1.75 inches and the card gap value was 95.

EXAMPLE 9

A system of 52% NQ, 18% aluminum powder, 20% TNT, and 10% binder was prepared. The binder was the hydroxyl terminated polypropylene glycol having a molecular weight of 1960 cross-linked with PAPI 135. This product was gray in color and is an insensitive blast explosive.

EXAMPLE 10

A system of 65% NQ, 25% TNT, and 10% of the binder of Example 9 was prepared. This product exhibited a detonation velocity of 4.9 km./sec., a critical diameter of about 7.8 inches, and a card gap value of 55.

In summary then, it has been discovered that a low molecular weight polymer cross-linked with an isocyanate can provide an excellent solvent binder for TNT which will not exhibit undue shrinkage, will adhere to the casing and is capable of retaining a solids load much higher than conventional binder systems.

In addition, the explosive of this invention is capable of being manufactured in conventional TNT plants utilizing low shear mixers which greatly reduce the cost of production over conventional PBX systems.

The HMX/TNT system was found to exhibit a much better reproducibility of performance as a shaped charge over conventional systems. The card gap exhibited indicated a relative insensitivity.

The invention may be embodied in other specified forms without departing from the spirit or essential characteristics thereto. The present embodiments are therefore to be considered in all respects as illustrative and not restrictive, the scope of the invention being indicated by the appended claims rather than by the foregoing description, and all changes which may come within the meaning and range of equivalency of the claims are therefore intended to be embraced therein.

I claim:

1. An explosive composition comprising in a mixture 15 to 90 percent by weight 2,4,6 trinitrotoluene 10 to 85 percent by weight of a polymer comprising an hydroxy telomerized polyol having a functionality of at least two cross-linked with a polyisocyanate having a functionality of at least two said polymer having a solubility parameter range of 10.5 to 13.5 $(cal./cc)^{\frac{1}{2}}$ and said polyol and polyisocyanate each having a molecular weight of no more than about 1000.

2. The composition of claim 1 wherein the polymer is present in from 2 to 10 percent.

3. The composition of claim 1 wherein the polyol is at least one member selected from the group polyethylene glycol and polyethylene glycol adipate.

4. The composition of claim 1 further comprising up to about 82 percent by weight of a particulate explosive selected from the group consisting of cyclotrimethylene trinitramine, cyclotetramethylene tetranitramine, nitroguanidine, 3 nitro 1,2,4 triazoyl 5-one and ammonium picrate.

5. The composition of claim 1 further comprising an explosion enhancing amount of at least one member selected from the group consisting of nitric or perchloric acid salts sodium, potassium, barium and lead and magnesium, aluminum and beryllium powders.

* * * * *